US006404311B1

(12) United States Patent
Loukas

(10) Patent No.: US 6,404,311 B1
(45) Date of Patent: Jun. 11, 2002

(54) MAGNETIC LIGHT SWITCH WITH HERMETIC GLASS BOX

(76) Inventor: Kauko Jalmari Loukas, Kemintie 969, Rovaniemi (FI), 96700

( * ) Notice: Subject to any disclaimer, the term of this patent is extended or adjusted under 35 U.S.C. 154(b) by 0 days.

(21) Appl. No.: 09/834,279

(22) Filed: Apr. 13, 2001

(51) Int. Cl.[7] ..... H01H 9/00

(52) U.S. Cl. ..... 335/205

(58) Field of Search ..... 335/205–208

*Primary Examiner*—Ramon M. Barrera

(57) ABSTRACT

The construction of the invention is composed of a hermetically sealed cylindric glass box filled with inert gas, a broad U-shaped permanent magnet on it; two pairs of galvanized, impermanently magnetizable steel pieces inside the glass box, on its brim, with electric wires brought from one pair of pieces, electrodes, to an outside source of electric current; an impermanently magnetizable galvanized steel bar inside the glass box, turned on and off between the steel pieces by the U-magnet; a hand lever turning the U-magnet; and a housing box, in which the magnetic light switch has been installed. The hermetic glass box can be made using the technics of electric bulbs. There is no burning and consuming dirt and dust inside the glass box, and inert gas inside the box prevents sparking from burning metal surfaces and generating ozone and nitrogen oxides, too. The invention is applicable to other purposes, too, e.g. to master and idividual switches of electric systems and devices. Safety can be increased with two bimetallic triggers inside the glass box cutting the electric current, if the device is heating too much.

2 Claims, 3 Drawing Sheets

MAGNETIC LIGHT SWITCH WITH HERMETIC GLASS BOX

BACKGROUND OF THE INVENTION

This invention relates to the need to produce light switches that are more fireproof and durable against wearing-out than common switches, that don't collect dust and dirt in the switch case for consumption and fire, and that don't produce ozone and nitrogen oxides by sparking.

DESCRIPTION OF THE PRIOR ART

The traditional light switches include a lever that closes and opens a gap between the voltage and the zero electrodes. The contact happens in normal air (and oxygen) between two metal surfaces of brass, copper or other galvanic material with good conductivity. There are some disadvantages in this kind of switches: sparking can't be avoided entirely, and it burns the contact surfaces; sparking can set fire to the dust and greasy dirt that has accumulated inside the switch case, as well as the whole building, or blow up the building, if there's exploding gas inside; dust and dirt consume the contact surfaces and, when burned by sparking in oxygen, produce carbon deposits that worsen conductivity. Also, ozone as well as nitrogen oxides that sparking produces are harmful.

SUMMARY OF THE INVENTION

The construction of the invention is composed of: a hermetically sealed cylindric glass box filled with inert gas; a broad U-shaped permanent magnet on it; two pairs of galvanized, impermanently magnetizable steel pieces inside the glass box with electric wires brought from a pair of the pieces electrodes, to an outside source of electric current; an impermanently magnetizable galvanized steel bar inside the box, turned between the steel pieces by the U-magnet; a hand lever turning the U-magnet; and a housing box, in which the glass box is installed. The glass box can be made using the technics of electric bulbs. There is no burning and consuming dirt and dust inside the glass box and inert gas inside the glass box prevents sparking from generating harmful gases and prevents burning metal surfaces, too. Safety can be increased with two bimetallic triggers inside the glass box cutting the electric current, if the device is heating too much.

DETAILED DESCRIPTION

Figure 1:
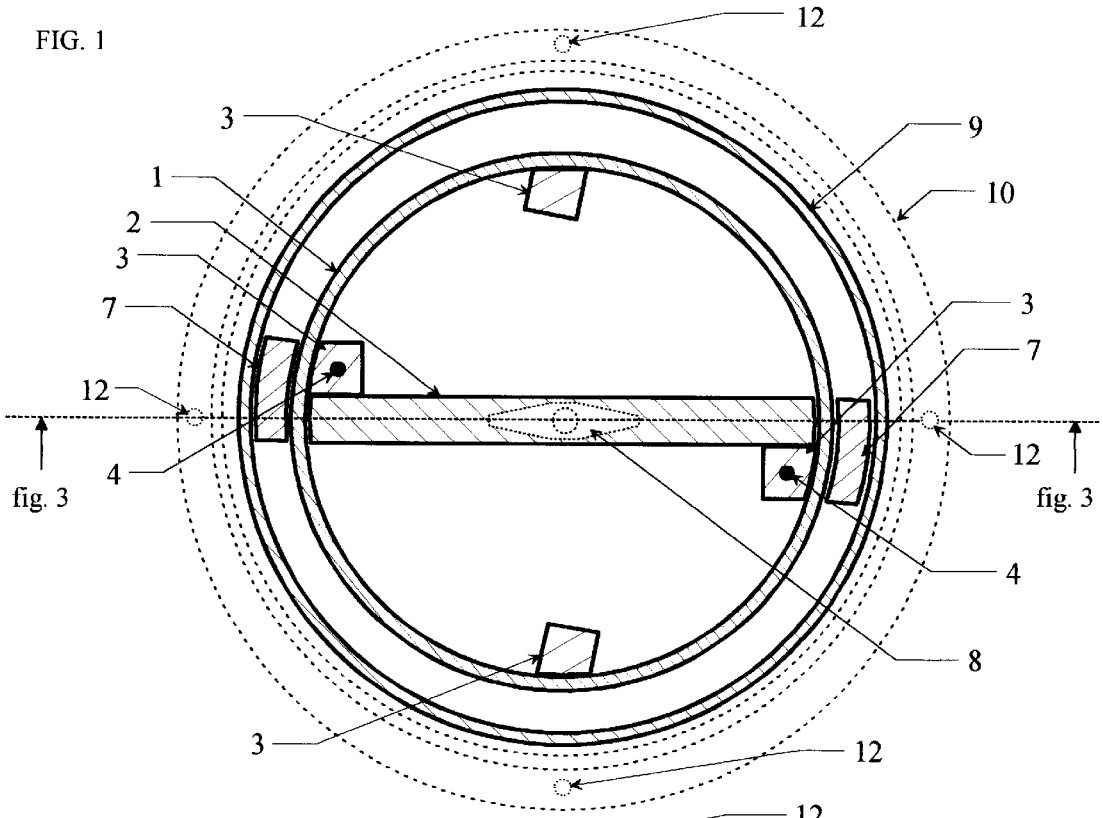
FIG. 1 represents the vertical section view of the magnetic light switch, the electrical current as connected, with hermetic glass box as sealed. Number 1 means the glass box. Number 2 is the galvanized steel bar inside the glass box. Number 3 are the two pairs of galvanized, impermanently magnetizable, steel pieces, and number 4 two electric pins. Number 7 is the U-shaped permanent magnet with the hand lever number 8 that is pressed into the center of the U-magnet. Number 9 is the housing box with the lid 10 fixed on it. Number 12 are the fixing screws.
Figure 2:
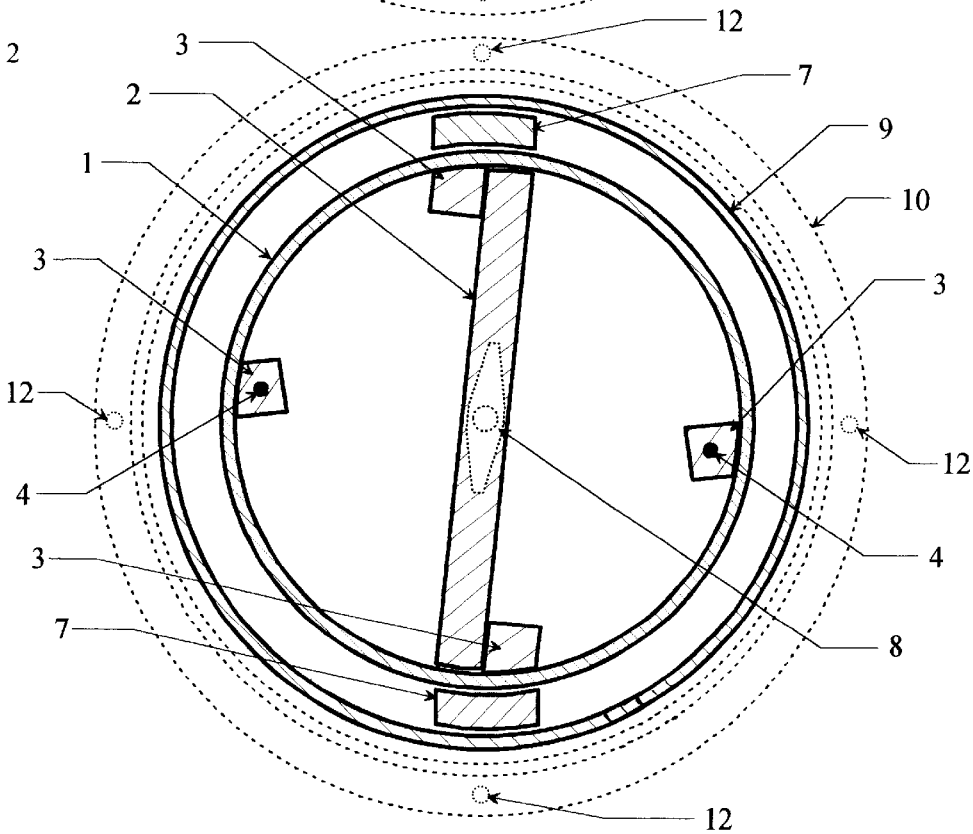
FIG. 2 represents the vertical section view of the magnetic light switch, when the electric current is off, including the same parts as the FIG. 1.
Figure 3:
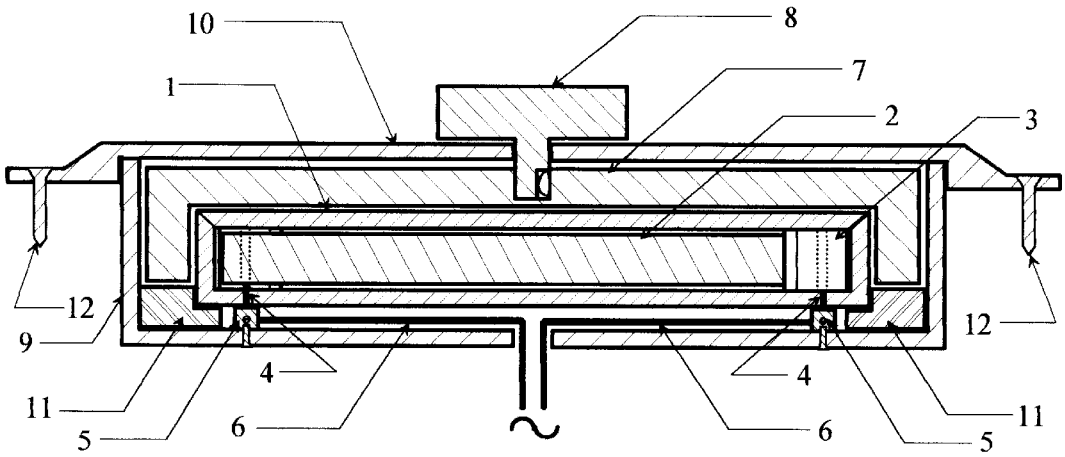
FIG. 3 represents the horizontal section view of the magnetic light switch as in FIG. 1. Number 1 means the glass box. Number 2 is the galvanized steel bar inside the box. Number 3 are the two pairs of galvanized, impermanently magnetizable steel pieces and number 4 two electric pins pressed into the corresponding electric connectors number 5. Number 6 are the electric wires brought from the connectors to the electric source. Number 7 is the U-shaped permanent magnet with the hand lever number 8 pressed into the center of the U-magnet. Number 9 is the housing box with the lid 10. Number 11 is the elastic ring keeping the glass box in its place. Number 12 are the fixing screws of the device.
Figure 4:
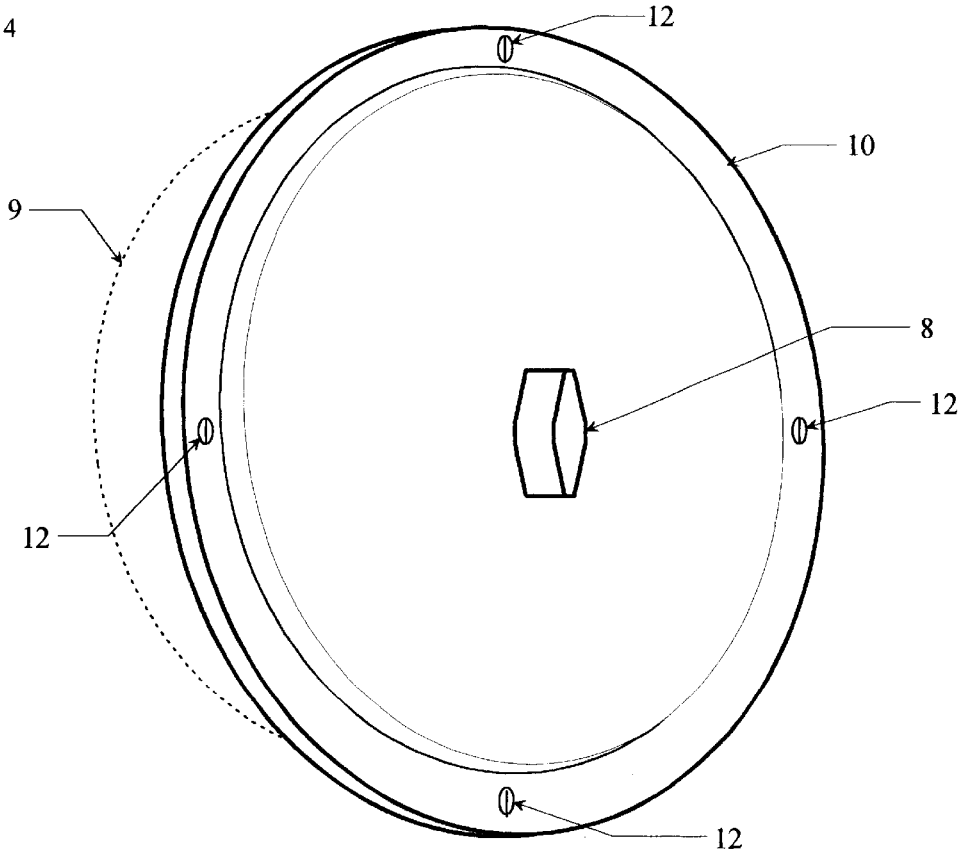
FIG. 4 represents the magnetic light switch as fixed on a wall. Number 8 is the hand lever turning the switch on and off. Number 9 is the housing box with the lid 10. Number 12 are the fixing screws.

The center part of the invention is a hermetically sealed cylindric glass box (FIGS. 1–3, no 1), filled with inert gas, as argon. The glass box can be made by the technics of electric bulbs. A broad U-shaped permanent magnet (FIGS. 1–3, no 7) has been placed on the glass box on the rooms side, turned by the hand lever (FIGS. 1–4, no 8). Two pairs of galvanized, impermanently magnetizable, sharp cornered, steel pieces (FIGS. 1–2, no 3) has been attached with some hard fixing agent inside the glass box (no 1), on its brim, at right angles to each others. In one pair, which are the two electrodes, has been fixed two electric pins (FIGS. 1–3, no 4). When the device is assembled, the pins are pressed into the two connectors (FIGS. 3, no 5) with two electric wires brought to an outside source of electric current. An impermanently magnetizable, rectangular, galvanized steel bar (FIGS. 1–3, no 2) has been placed inside the glass box (no 1), so that it can turn between the electrodes (FIGS. 1–2, no 3 and 4). When the hand lever (no 8), the axis of which has been pressed into the hole in the center of the U-magnet (no 7), turns the U-magnet onto the electrodes, the electric current is on. When the lever is turned to the opposite direction, the current is off. The U-magnet (no 7), steel bar (no 2) and one pair of the steel pieces (no 3) consist a magnetic circuit, creating clicking on- and off-function, which is necessary to electric switches to lessen sparking (FIGS. 1–2).

In the housing box (FIGS. 1–4, no 9) the magnetic light switch has been installed using the fastening ring (FIG. 3, no 11) that can be made of some elastic material, e.g. rubber. The housing is made of some hard, strong plastic or other material as the counterpart of conventional light switches, and it is closed with the lid (FIGS. 1–4, no 10) using a screwed or other fastening. The axis of the hand lever (no 8) is pressed through a sliding-contact bearing in the center of the lid (no 10) and into the hole in the center of the U-magnet (no 7), fixing the axis on its halfly cut end with a lock spring or by other means. The whole device is fixed on a wall with 2 to 4 fixing screws (FIGS. 1–4, no 12).

There is no burning and consuming dirt and dust inside the glass box (no 1), and inert gas prevents sparking from burning metal surfaces and generating ozone and nitrogen oxides, too. The gas pressure inside the glass box has to be the normal air pressure, and the box has to be sealed with some hard fixing agent, so that the inert gas can't leak out. The galvanization has to be made with some galvanic metal that has a good conductivity, and it needs to be thick enough to endure consumption. The invention can be used to some other applications, too, e.g. to master and individual switches of electric systems and devices. The size of the invention is free, depending on the amperage, voltage and other criterions.

Figure 5:
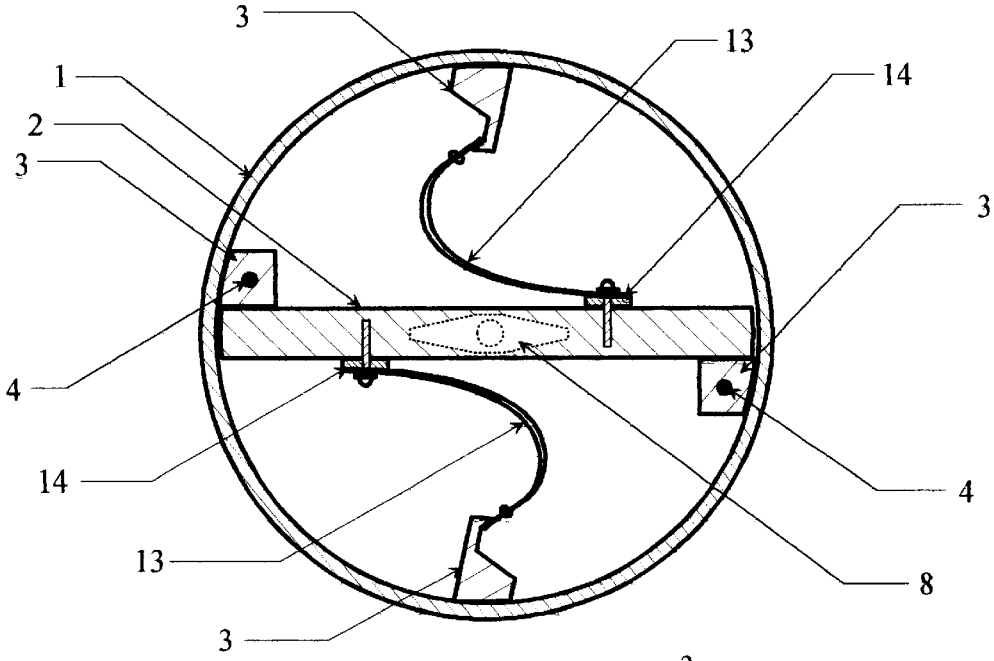
FIG. 5 represents the two bimetallic triggers number 13 that cut the electric current, when the glass box 1 is heating too much. The switch is closed (on) in this figure. The triggers has been fixed on their positions with dielectric, thin, flat pieces number 14 and screws.
Figure 6:
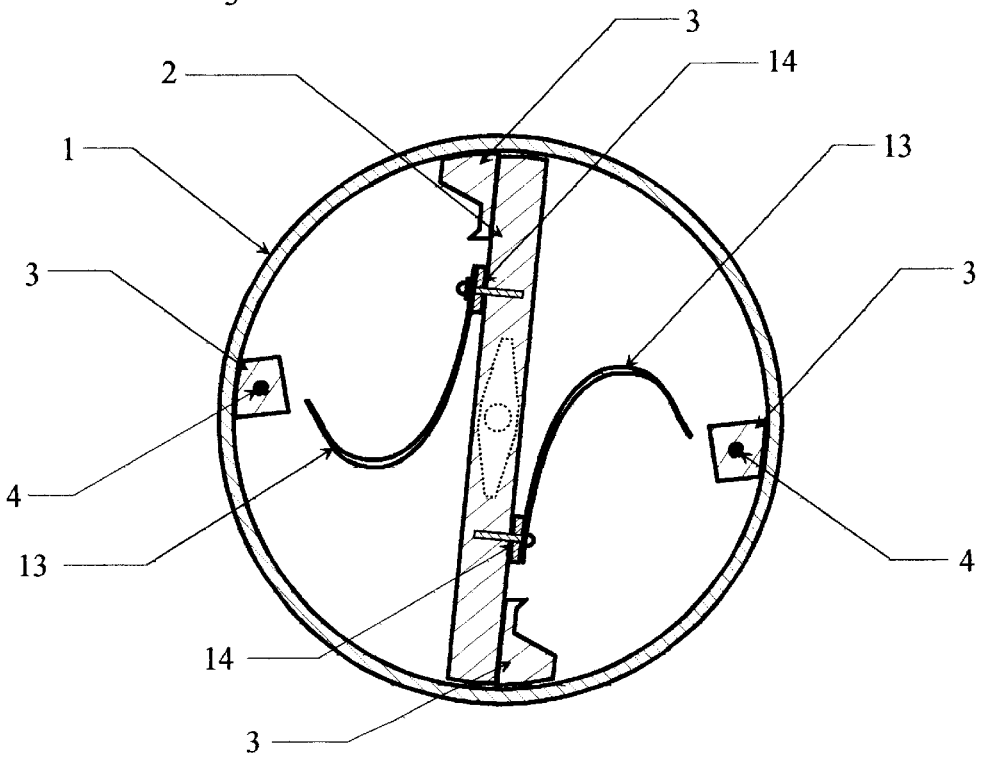
FIG. 6 is the same as FIG. 5, except that the switch is now open (off), and the triggers number 13 have done their work and are cooling enough for reconnecting the switch.

Safety can be increased with two bimetallic triggers (FIGS. 5 to 6, no 13) that are installed inside the glass box (no 1), on the sides of the steel bar (no 2), symmetrically in regard to the center point of the U-magnet, so that they will disconnect the electric current by curving more inwards, if the glass box, and the triggers, are heating too much. In the FIG. 5 the switch is closed (on), and the triggers have not heated yet. In the FIG. 6 the triggers have opened the switch and are cooling, so that the switch can bee closed soon again, if the cause that has heated the device, has ceased to exist.

What is claimed is:

1. Magnetic light switch with hermetic glass box, comprising:

a hermetically sealed cylindrical glass box, made by the same technics as electric bulbs, being installed in a housing box in a hole on a wall;

the said glass box being filled with inert gas;

a broad U-shaped permanent magnet being placed on the glass box, so that it can be turned with a hand lever clockwise and counterclockwise;

two pairs of galvanized, impermanently magnetizable, sharp-cornered steel pieces being attached with some hard fixing agent inside the said glass box, on its brim, at right angles to each others;

two electric pins being fixed in one pair of said pieces, called electrodes, pressed into little holes in the said electrodes, protruding outside the said glass box, on the back side of it;

the said electric pins, the device being assembled, being pressed into the holes in one pair of connectors with a pair of electric wires to an outside source of electric current;

an impermanently magnetizable, rectangular, shaped like a prism, galvanized steel bar being placed inside the said glass box, so that the said steel bar can be turned between the said steel pieces;

the said steel bar being turned by the said hand lever onto the said electrodes, so that the electric current is on, and to the opposite direction, so that the current is off;

the said U-magnet, said steel bar and one pair of the said steel pieces consisting a magnet circuit, creating clicking on- and off-function to lessen sparking;

the said glass box being installed in its housing box using a rubber or other elastic ring;

the said housing box being made of some hard and strong dielectric material and closed with a lid of same as the said housing or other suitable material, using proper fastening;

the axis of the said hand lever being pressed through a sliding-contact bearing in the center of the said lid and into a hole in the center of the U-magnet, the said axis being fixed on its halfly cut end with a lock spring or by other means;

the said whole device being fixed on a wall with 2 to 4 fixing screws, or by other means;

burning and consuming dirt and dust being prevented from getting inside the said glass box and consuming the metal surfaces by sealing the box with some hard agent when assembling the box, and protruding the said two electric pins out of it, and inert gas inside the said glass box preventing sparking from burning said dirt and dust as well as the metal surfaces inside the said glass box;

galvanizing of said parts inside the said glass box being of good conducting metal and thick enough to endure on- and off-function of the said switch;

the said magnetic switch being applicable to light switches, as well as to master switches of electric systems and individual switches of electric devices, by changing its size and other criterions according to the amperage and voltage used.

2. A light switch according to claim 1 having:

two bimetallic triggers that have been installed inside the said glass box, so that they can disconnect the electric current by curving more inwards and turning the said steel bar off from the electrodes, if the said glass box and the triggers are heating too much;

the said triggers allowing to reconnect the current, when the said switch has cooled enough; the said triggers being fixed on the opposite sides of the said steel bar with dielectric, thin, flat pieces and screws, symmetrically in regard to the center point of the U-magnet.

* * * * *